United States Patent [19]

Wix

[11] 4,406,183

[45] Sep. 27, 1983

[54] FAST ACTING RATCHET WRENCH

[76] Inventor: Jerry W. Wix, 125 Airport Rd., Portand, Tenn. 37148

[21] Appl. No.: 289,048

[22] Filed: Jul. 31, 1981

[51] Int. Cl.[3] ..... B25B 17/00

[52] U.S. Cl. ..... 81/57.29; 81/62; 192/95; 192/96

[58] Field of Search ..... 81/57.29, 58.2, 62; 192/95, 96; 74/371

[56] References Cited

U.S. PATENT DOCUMENTS

| | | | |
|---|---|---|---|
| 3,396,593 | 8/1968 | Moores | 74/371 |
| 3,785,443 | 1/1974 | Armbruster | 74/371 |
| 4,086,829 | 5/1978 | Hudgins | 81/57.29 |
| 4,277,989 | 7/1981 | Tracy | 81/62 |
| 4,300,413 | 11/1981 | Garofalo | 81/62 |

*Primary Examiner*—James L. Jones, Jr.
*Attorney, Agent, or Firm*—Luedeka & Neely

[57] ABSTRACT

The specification discloses a fast-acting ratchet wrench (10) which operates in a fast-acting mode of operation and a normal mode of operation. Wrench (10) includes a grip (16) rotatably mounted on one end of a handle (12) with a wrench head (14) disposed on the other end thereof. A rod (74) is attached to the grip (16) and extends through the handle (12) and into the wrench head (14). A drive gear (50) is mounted on the rod (74) within the wrench head (14), and constantly engages teeth (130) on a drive wheel (26). A drive stud (18) is mounted on the wheel (26). A pin (76) is fixedly mounted extending through the rod (74) at a position proximate to the drive gear (50). The wrench (10) is placed in the fast-acting mode of operation by pulling the grip (16) and rod (74) in a direction away from the wrench head (14) to move the pin (76) into slots (66 and 70) or (68 and 72) in the gear (50). To place the wrench (10) in the normal mode of operation, grip (16) is moved towards the wrench head (14) to insert the pin (76) into slots (84 and 88) or (86 and 90) in the wrench head (14).

13 Claims, 10 Drawing Figures

FAST ACTING RATCHET WRENCH

FIELD OF INVENTION

The present invention relates to the field of ratchet wrenches and particularly relates to fast-acting ratchet wrenches that may be placed in a fast-acting mode of operation whereby a drive stud is rotated by the rotation of a handgrip about an axis generally perpendicular to the drive stud.

BACKGROUND OF THE INVENTION

Fast acting ratchet wrenches are socket wrenches having a drive stud that may be rotated in one of two modes of operation, a normal mode or a fast acting mode. Examples of such wrenches are disclosed in U.S. Pat. Nos. 4,128,025 to Main et al; 4,086,829 to Hudgins; and 3,707,893 to Hofman. The wrench disclosed in the Hudgins patent includes an elongate handle having a head mounted on one end and cylindrical hand grip mounted on the other end thereof. A drive stud is mounted for rotation in the head of the wrench on an axis perpendicular to the handle, and a first beveled gear is mounted on the rear side of the drive stud. A second beveled gear is disposed for engaging the first beveled gear, and a rod is attached to and extends from the second beveled gear to a clutch assembly that is interconnected with the cylindrical grip. In the fast-acting mode of operation, the grip is rotated to rotate the rod which in turn rotates the beveled gears to rotate the drive stud. The drive stud may be rotated in the fast-acting mode of operation until a selected resistence torque is placed on the drive stud by a nut or bolt being driven at which point the clutch assembly begins to slip. The nut or bolt may then be further tightened only by oscillating pivotal movement of the handle about the drive stud in a normal ratchet wrench action. The oscillating pivotal movement of the handle will cause the drive stud to rotate relative to the head and will also rotate the beveled gears and the rod. The rod will impart a rotational force on the clutch assembly that, in turn, imparts a rotational force on the grip. The rotational force on the grip must be resisted by the user so that when the wrench is used in the normal mode, the user will maintain the handgrip in a stationary position relative to the wrench, and the clutch must slip to allow rotation of the rod.

In a alternate construction of the fast-acting wrench of Hudgins, as shown in FIG. 5, the two beveled gears may be disengaged by sliding the grip, and the rod in a direction away from the wrench head. In this configuration, use of the fast-acting wrench as a conventional ratchet wrench will not rotate the second beveled gear and the rod, but the grip on the handle is free to rotate.

The basic problem associated with fast-acting ratchet wrenches is that they tend to wear out quickly or frequently malfunction, especially after extended use. Typically, fast-acting wrenches employ a gear system that selectively engages and disengages to switch the wrench between a fast-acting mode of operation and a normal or conventional operation. [Because of the angle of the drive surfaces on the teeth of gears, a torque applied to most gear systems tends to separate the gears.] When such torque reaches a sufficiently high level, the gears will often jump out of gear, and such malfunction will chip or wear the gears. This problem is especially bothersome in fast acting wrenches that utilize beveled gearing, such as the two 45° beveled gears disclosed in Hudgins. Also, repetitive engagement and disengagement of the gears will wear the gears and make them more susceptible to malfunction by jumping out of gear.

A clutch assembly that limits the amount of torque that may be applied to a gear system of a fast-acting ratchet wrench will protect the gear system to some degree, but the clutch assembly is expensive to manufacture and install in the wrench, will itself wear out quickly due to the necessary slippage in the clutch assembly, and may prevent the user from applying a desired torque to the gear system. Also, the clutch system in Hudgins may possibly be adjusted to the point that it no longer functions as a clutch, and in such a case a torque may be applied to the gear system causing the beveled gears to disengage or jump out of gear.

Furthermore, when a clutch system is provided, such as is disclosed in Hudgins, the grip trys to rotate when the wrench is used in a normal or conventional operation mode. Such rotation of the grip impairs the usefulness of the fast-acting ratchet wrench when used in the normal mode and, at a minimum, is a bother to the user.

Thus, a need has arisen for a fast-acting ratchet wrench that may be easily and reliably switched between a fast-acting mode of operation wherein a drive stud is rotated by the rotation of a handle, handgrip, or like device in a rotational axis generally perpendicular to the drive stud and a normal mode of operation wherein the drive stud is rotated by oscillating pivotal motion of the handle about the drive stud. Such fast-acting ratchet wrench needs to resist gear jumping, the damage caused by gear jumping and the damage caused by repetively engaging and disengaging a gear system. Such fast-acting ratchet wrench also needs to avoid the use of a clutch system because of their inherent expense and tendency to wear out quickly, and needs to provide structure to avoid free rotation of the handle or grip when the fast-acting ratchet wrench is used in the normal mode of operation.

SUMMARY OF THE INVENTION

The present invention solves the foregoing problems and others long associated with fast-acting ratchet wrenches by providing an improved drive system. In accordance with the present invention, the improvement is provided in a ratchet wrench having an elongate handle, a head on one end of the handle, a drive wheel rotatably mounted in the head with a stud extending from the center thereof for insertion into wrench sockets, and a rod having a center axis extending through the center of the handle, into the head and adjacent to the drive wheel. The improvement includes a drive gear rotatably mounted on the rod, and a retainer for securing and retaining the drive gear in a substantially stationary position on the rod relative to the drive wheel. Teeth are formed on the drive wheel disposed circumferentially about the center of the wheel and are positioned to continuously engage the drive gear. An interlock selectively locks the drive gear to the rod to selectively switch the drive gear from a free-wheeling mode of operation to a drive mode of operation. In the drive mode of operation, the drive gear is operable to rotate in unison with the rod to drive the teeth on the drive wheel and to rotate the wheel and the stud and, thus, the wrench is placed in a fast-acting mode of operation. In the free-wheeling mode, the drive gear rotates freely on the rod in response to rotation of the drive wheel. Thus, the drive wheel and stud may be selectively rotated by switching the drive gear into the drive mode and rotating the rod about its own center axis.

In accordance with a more particular embodiment of the present invention, the improvement is formed in a ratchet wrench having an elongate handle with first and second ends. A head is formed on the first end of the handle and a handgrip is slidably mounted on the second end of the handle for axial sliding movement in a direction parallel to the handle and for sliding rotational movement on the handle about the center axis of the handgrip. A rod is mounted for sliding movement through the interior of the handle and into the wrench head. A drive wheel is rotatably mounted in the head adjacent to the rod with a stud extending outwardly from the center of the drive wheel for insertion into wrench sockets. A ratchet mechanism engages the drive wheel to prevent rotation of the drive wheel in a selected rotational direction.

An interlock for selectively locking the drive gear to the rod includes at least one projection extending from and being fixed on the rod, and at least one gear cavity is formed in the gear and is dimensioned for receiving and mating with the projection. The rod is slidably mounted in the handle so that the rod may be shifted in a direction parallel to its center axis to move the projection into the gear cavity to lock the gear on the rod and switch the drive gear into the drive mode. A head cavity is formed in the head of the wrench and is dimensioned and positioned to snuggly receive the projection. When the rod is shifted to remove the projection from the gear cavity and switch the gear to the free-wheeling mode, the projection is inserted into the head cavity to lock the rod in a fixed position. A gap is formed in the head between the drive gear and the head cavity and is dimensioned to receive the projection and to allow the projection to rotate on the rod within the gap. When the projection is removed from the gear cavity, it moves into the gap and may be rotated within the gap into alignment with the head cavity for insertion therein.

In accordance with another aspect of the invention, the drive gear is rotatably mounted on the rod and a retainer secures and retains the drive gear at a substantially stationary position on the rod relative to the drive wheel. Teeth are formed in the drive wheel disposed circumferentially about the center of the drive wheel and positioned to continuously engage the drive gear. A gear interlock is formed on the rod for selectively locking the drive gear to the rod to selectively switch the drive gear from a free-wheeling mode of operation to a drive mode of operation in response to sliding axial movement of the handle. The drive gear is operable in the drive mode to operate in unison with the rod to drive the teeth on the drive wheel and to rotate the wheel and the drive stud. The drive gear is operable in a free-wheeling mode to rotate freely on the rod in response to rotation of the wheel. Thus, the drive wheel and the stud may be selectively rotatably driven by sliding the grip axially on the handle to switch the drive gear into the drive mode and rotating the grip on the handle.

The ratchet mechanism in the wrench includes a toggle ratchet mechanism for engaging the drive wheel and being movable between first and second mechanism positions to prevent rotational movement of the drive wheel in a first rotational direction when the mechanism is in the first position and to prevent rotational movement of the drive wheel in a second rotational direction when the mechanism is in the second position. An actuator is mounted on the handle adjacent to the grip and is movable between first and second actuator positions. Transmission means are connected between the actuator and the ratchet mechanism to transmit mechanical force therebetween. In response to the actuator, the transmission means moves the mechanism to the first mechanism position when the actuator is moved to the first actuator position and moves the mechanism to the second mechanism position when the actuator is moved to the second actuator position.

BRIEF DESCRIPTION OF THE DRAWINGS

The present invention may best be understood by reference to a particular embodiment described in the Detailed Description when considered in conjunction with the Drawings in which.

DETAILED DESCRIPTION

Figure 1:
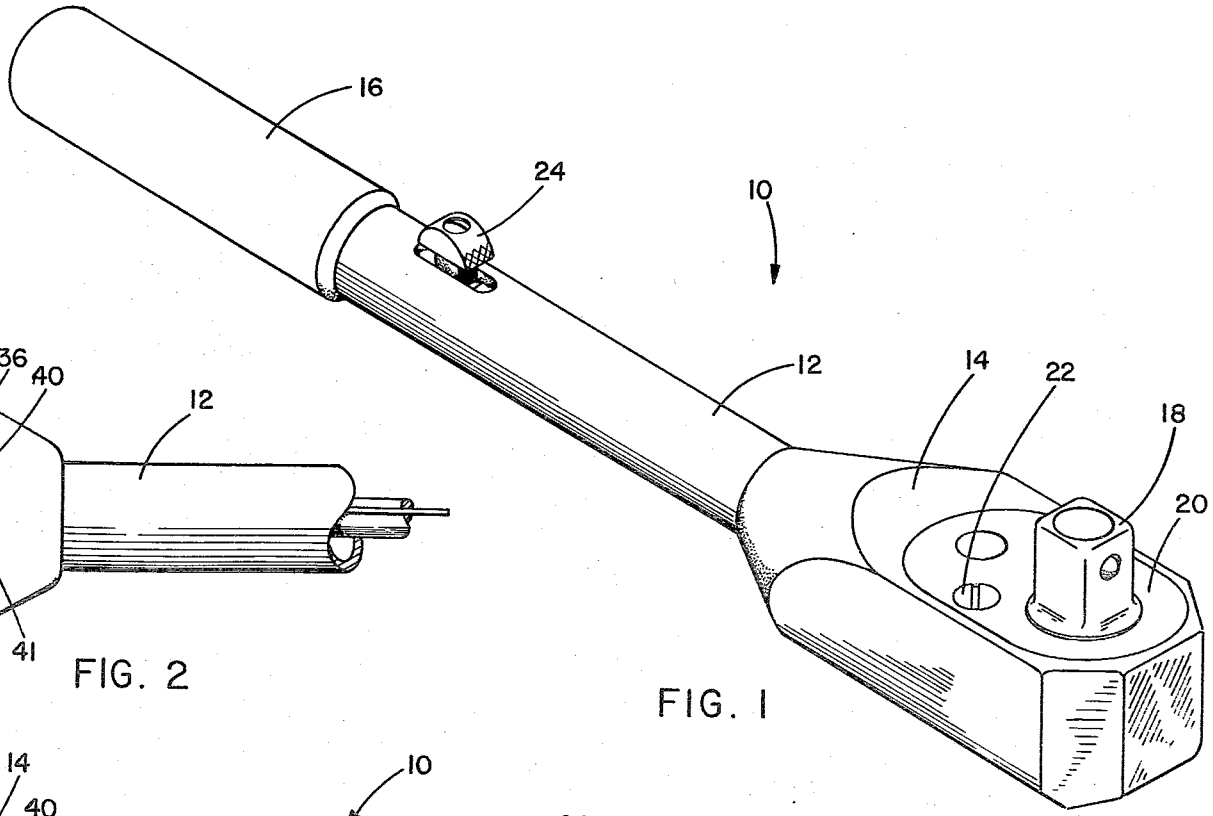
FIG. 1 is a perspective view of a fast-acting ratchet wrench embodying the present invention.

Referring now to the drawings in which like reference characters designate like or corresponding parts throughout the several views there is shown in FIG. 1 a fast-acting ratchet wrench 10 embodying the present invention. Wrench 10 includes a handle 12 with a wrench head 14 formed on one end of the handle and a cylindrical grip 16 mounted on the other end thereof.

A conventional drive stud 18 extends outwardly from the head 14 in a direction perpendicular to the handle 12. The drive stud 18 is dimensioned to fit into standard socket wrenches for driving nuts, bolts, and the like, and a coverplate 20 is secured over the drive stud 18 and on the wrench head 14 by a plurality of screws 22. The coverplate 20 may be removed to remove and/or install parts within the head 14.

A ratchet mechanism is contained within the head 14 so that the stud 18 may be rotated in one selected direction, but not the other. Such mechanism is controlled by an actuator 24 that is mounted on the handle 12 adjacent to grip 16 and may be moved between first and second positions to switch the ratchet mechanism to select the direction in which the drive stud may be rotated.

Figure 2:
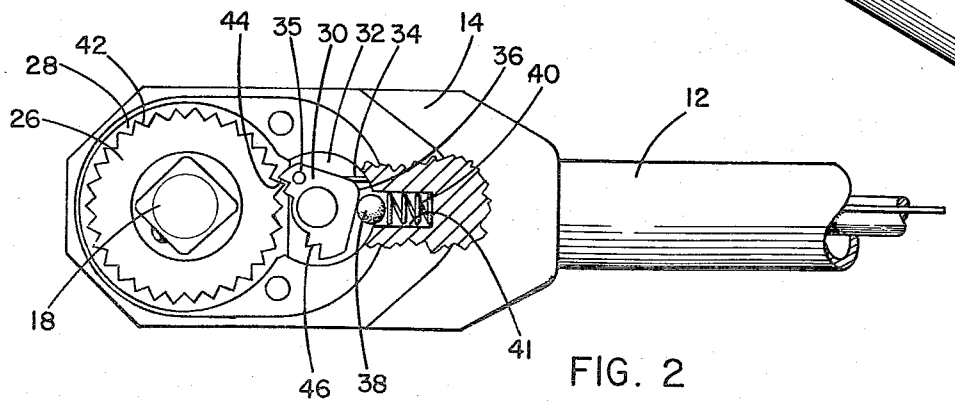
FIG. 2 is a top view of the ratchet wrench head with a cover plate removed and portions of the head cut away to reveal the operation of the toggle ratchet mechanism.

Referring now to FIG. 2, there is shown a top view of the wrench head 14 and a portion of the handle 12 with the coverplate 20 removed and with a portion of the head 14 cut away to reveal interior parts. The drive stud 18 is mounted on and extends upwardly from a drive wheel 26 that is rotatably mounted in a cylindrical cavity 28 formed in the wrench head 14. A ratchet mechanism is rotatably mounted in another cylindrical cavity 32 in the wrench head 14 adjacent to the drive wheel 26. The position of the ratchet mechanism 30 is controlled by a wire 34 that is connected to the ratchet mechanism at an aperture 35. A cam 36 is disposed adjacent to the back side of the ratchet mechanism 30 for operating against a ball 38 and spring 40 so that the ratchet mechanism 30 is held in one of two positions, one of such positions being shown in FIG. 2. The spring 40 is mounted in a cavity 41 formed in the wrench head 14.

A plurality of wheel teeth 42 are formed circumferentially about the perimeter of the drive wheel 26, and ratchet teeth 44 are formed on one side of the ratchet mechanism 30 for engaging the wheel teeth 42 when the ratchet mechanism 30 is in the position shown in FIG. 2. In this configuration, the drive stud 18 may be rotated in a positive or counterclockwise rotation relative to the wrench 10.

Ratchet teeth 46 are formed on the opposite side of the ratchet mechanism 30 from the teeth 44. When it is desired to rotate the drive stud 18 in a negative or clockwise rotational direction relative to the wrench 10, the ratchet mechanism 30 is moved or toggled to interengage the ratchet teeth 46 and the wheel teeth 42 as shown in FIG. 3.

Figure 3:
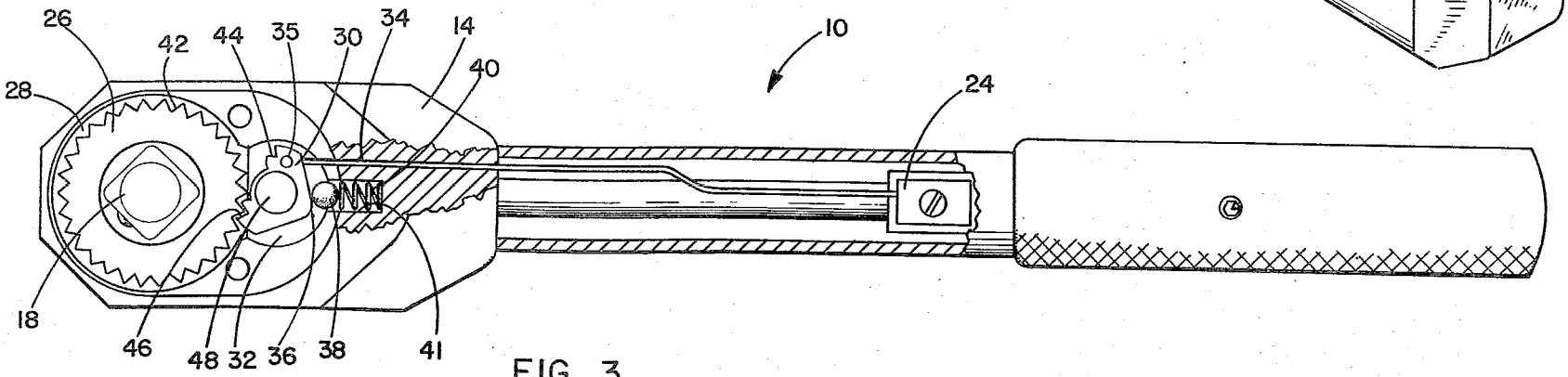
FIG. 3 is a top view of the wrench with a cover plate removed and portions of the wrench cut away to reveal the operation of the toggle ratchet mechanism in a second position.

Referring to FIG. 3, there is shown a top view of the wrench 10 with the coverplate 20 removed and portions of the wrench 10 cut away to reveal interior parts. In this view, ratchet mechanism 30 has been moved to its second position with the ratchet teeth 46 interengaged with the wheel teeth 42. It will be appreciated by comparing FIGS. 2 and 3 that the ratchet mechanism 30 has rotated about an axis 48 formed in the center of the ratchet mechanism 30. During the rotation, the cam 36 rotated past the ball 38 forcing it towards and further into the cavity 41 and then, after the cam 36 has passed the ball, allowing the ball 38 to move outwardly towards the ratchet mechanism 30. In this manner, the spring 40 and ball 38 operate to hold the ratchet mechanism 30 in either the first or second positions shown in FIGS. 2 and 3, respectively. The wire 34 is rigidly connected between aperture 35 in the ratchet mechanism 30 and the actuator 24. Actuator 24 is free to travel towards and away from the ratchet mechanism 30 so that by pushing the actuator 24 towards the wrench head 14, the ratchet mechanism 30 is placed in the first position as shown in FIG. 2. By pulling the actuator 24 away from the wrench head 14, the ratchet mechanism 30 is placed into the second position as shown in FIG. 3.

Figures 4, 5, 6, 7, 8, 9, 10:
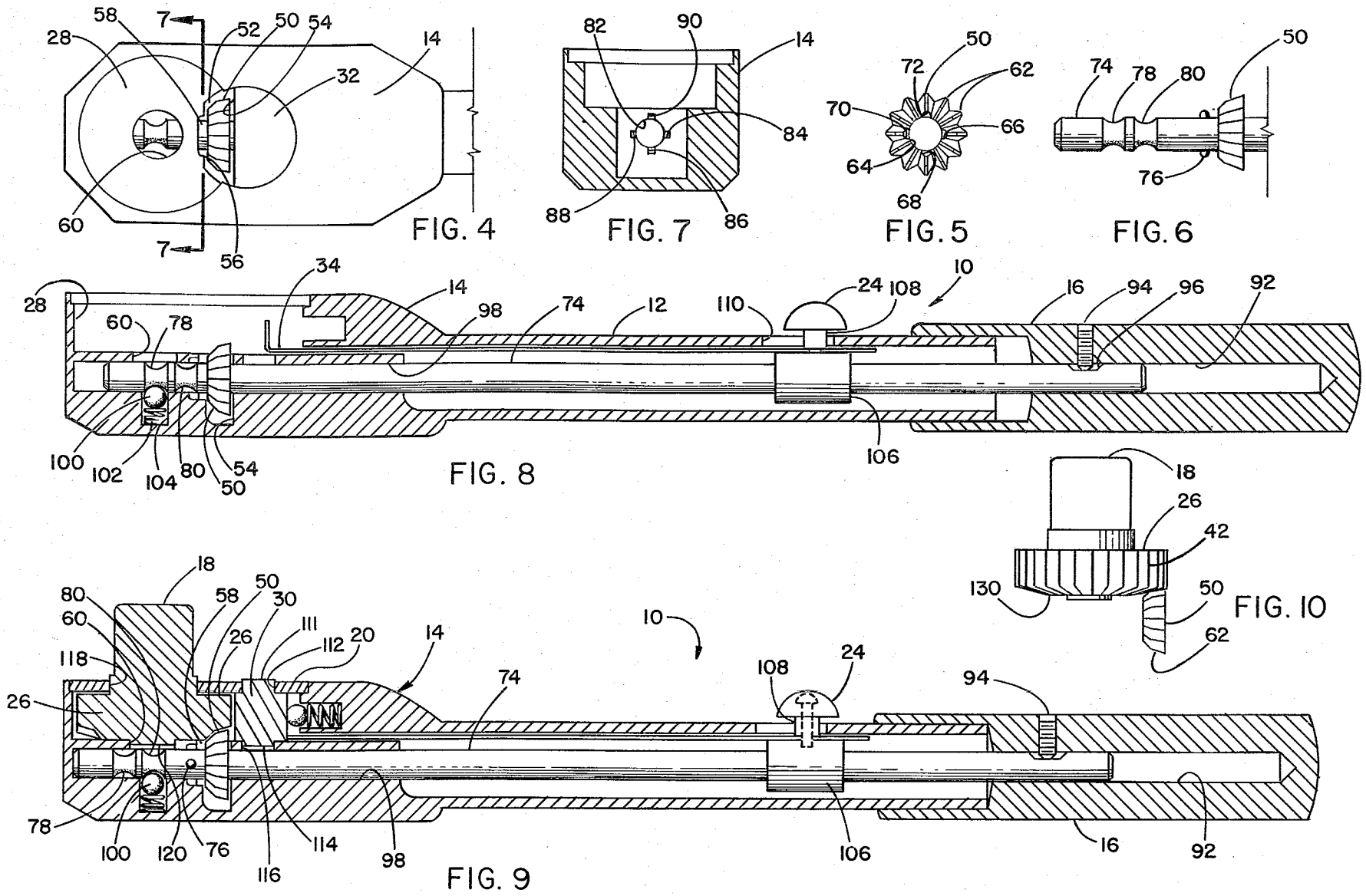
FIG. 4 is top view of the wrench head shown with a cover plate, a drive stud and a drive wheel removed to show the position of a drive gear therein.
FIG. 5 is a detailed view of the drive gear.
FIG. 6 is a partial view of a front portion of a rod on which the drive gear is mounted showing a pin for engaging the drive gear.
FIG. 7 is a cross-sectional view of the wrench head taken through section line 5—5 shown in FIG. 4.
FIG. 8 is a cross-sectional side view of the wrench with the drive stud and ratchet mechanism removed and with the drive gear positioned in the drive mode.
FIG. 9 is another side cross-sectional view of the wrench showing the handle and rod positioned so that the drive gear is in its free-wheeling position.
FIG. 10 is a detail perspective view of the drive stud, drive wheel and drive gear shown as they are positioned within the wrench head.

In FIG. 4 there is shown a top view of the wrench head 14 with the drive stud 18 and drive wheel 26 and the ratchet mechanism 30 removed to reveal a drive gear 50 that is normally disposed beneath the drive wheel 26 in a drive gear cavity 52. The drive gear 50 is retained in its position by a retaining wall 54 disposed behind drive gear 50 and by an annular retaining surface 56 disposed in front of the drive gear 50. Also, a gap 58, whose function will be described hereinafter, is formed in front of the drive gear 50.

Referring now to FIG. 5, there is shown a front view of drive gear 50 which includes a plurality of gear teeth 62 disposed along the circumference of drive gear 50 and extending radially outwardly from the center thereof. A cylindrical race 64 is formed in the center of gear 50 for rotatably mounting the gear on a cylindrical rod, and a plurality of slots 66, 68, 70 and 72 are formed in the gear 50 extending radially outwardly from the race 64. Slots 66 and 70 are formed on directly opposite sides of the gear 50 and may be considered one slot.-Likewise, slots 68 and 72 are formed on opposite sides of the gear 50 and may be considered one slot.

In FIG. 6, there is shown a detail view of a front portion of a rod 74 that is mounted in the center of the handle 12. The gear 50 is mounted on the rod 74 and is free to rotate when in the position shown in FIG. 6. Pin 76 is mounted extending through the rod 74 in a direction perpendicular thereto with the portions of pin 76 projecting from either side of the rod 74. The pin 76 is dimensioned so that it will fit and mate within the slots 66 and 70 or the slots 68 and 72 of the gear 50. To interlock the rod 74 and the gear 50, the pin 76 is aligned with an appropriate pair of slots, such as slots 66 and 70 or 68 and 72, and the rod 74 is translated axially until the pin 76 is inserted into the appropriate slots. In this manner, the gear 50 is locked on the rod 74 and will rotate in unison therewith.

Annular indents 78 and 80 are formed on the surface of the front portion of rod 74. These indents 78 and 80 are used to catch and hold the rod 74 in selected positions as will be hereinafter described. Referring now to FIG. 7, there shown a cross-sectional view of the wrench head 14 taken through the section lines 7—7 shown in FIG. 4. A bore 82 is formed in wrench head 14 and is dimensioned to receive the rod 74 so that the rod may be rotatably supported within the bore 82. A plurality of slots 84, 86, 88 and 90 are formed adjacent the bore 82 and extend radially outwardly therefrom. Slots 84, 86, 88 and 90 correspond to slots 66, 68, 70 and 72 in the gear 50 and, likewise, are dimensioned to snuggly receive the pin 76. To lock the rod 74 so that it will not rotate will respect to the wrench 10, the pin 76 is aligned with an appropriate pair of slots 84 and 88 or 86 and 90, and the pin is inserted into the slots. In this manner, the pin 76 will prevent rotation of the rod 74 with respect to the wrench 10.

Referring now to FIG. 8, there is shown a somewhat diagrammatical side cross-sectional view of wrench 10. In this view, there is shown the internal mechanism used to switch the wrench between a fast-acting mode of operation and a normal mode of operation.

The rod 74 is fixedly mounted in a bore 92 that is disposed in the center of the grip 16. In this embodiment, rod 74 is held in the grip 16 by a set screw 94 that is secured through the grip 16 and into a cavity 96 in the rod 74. The rod 74 is free to rotate on its axis or move axially in the wrench head 14. Likewise, the grip 16 is free to rotate about and slide axially on the handle 12 in unison with the rod 74.

The other end of the rod 74 (opposite from the grip 16) is slidably mounted in a bore 98 formed in the wrench head 14 and the rod 74 extends through the wrench head 14 to a position beneath the cavity 28 in which the drive wheel 26 is normally mounted. However, in FIG. 8, the drive wheel 26 and the ratchet mechanism 30 have been removed to clarify the illustration.

As previously mentioned, annular indents 78 and 80 are formed in the forward end of the rod 74 opposite from the grip 16. A ball 100, a spring 102 and a cavity 104 are disposed beneath the indent 78 when the wrench is in the position shown in FIG. 8. The spring 102 is disposed within the cavity 104 and urges the ball 100 towards the rod 74 and into indent 78. In this configuration, the ball will impart a force on the rod 74 through the indent 78 to resist sliding axial movement of the rod. However, with the exertion of a sufficient axial force on the rod 74, the ball 100 will be forced downwardly into the cavity 104 and the rod 74 will move axially.

The actuator 24 is mounted on a cylindrical slide 106 by a threaded mount 108 that extends through a slot 110 in the handle 12. Slide 106 is free to move towards and away from the wrench head 14, thus, moving the mount 108 within the slot 110. The wire 34 is connected to the mount 108 and, thus, to the actuator 24 so that movement of the actuator 24 causes axial movement of the wire 34.

As shown in FIG. 8, the wrench is positioned in the fast-acting mode of operation. To place the wrench 10 in this position, the grip 16 is pulled rearwardly and twisted until the pin 76 is inserted into the slots 66 and 70 or 68 and 72. Once the rod 74 is in the proper position, the ball 100 inserts into the indent 78 to hold the rod 74 in such position. Further rearward motion of the rod 74 and grip 16 is prevented by the pin 76 engaging the drive gear 50 within the slots 66 and 70 or 68 and 72. In this mode of operation, rotation of the grip 16 about the handle 12 will cause the drive gear 50 to rotate in unison with the handle and grip. The rotation of the drive gear 50 will rotate the drive wheel 26 and the drive stud 18.

Referring now to FIG. 9 there is shown a somewhat diagrammatical cross section of the wrench 10 shown in a position for operating in the normal mode of operation. To switch the wrench 10 from the position shown in FIG. 8 to the position of FIG. 9, the grip 16 has been moved towards the wrench head 14 sliding along the handle 12. The rod 74 has also been moved towards the wrench head of 14. The pin 76 was first moved into the gap 58, then aligned with slots 84 and 88 or 86 and 90, and then inserted into such slots. In the position of FIG. 9, the interaction between the pin 76 and the slots 84 and 88 or 86 and 90 will prevent the rod 74 and the grip 16 from rotating. The drive gear 50 is free to rotate on the rod 74 in unison with the drive wheel 26, and the ball 100 is disposed against the annular indent to retain the rod 74 in the proper position for operating the wrench 10 in the normal mode of operation. To switch the wrench 10 back into the fast-acting mode of operation, it is necessary to apply a sufficient force on the grip 16 in a direction away from the wrench head 14 to force the ball 100 back into the cavity 104.

The manner in which the ratchet mechanism 30 and the drive wheel 26 are mounted in the wrench head 14 is clearly shown in FIG. 9. A cylindrical axle 111 extends upwardly from the ratchet mechanism 30 and fits into a cylindrical aperture 112 in the coverplate 20. Another cylindrical axle 114 extends downwardly from the ratchet mechanism 30 and fits into another cylindrical aperture 116. Thus, the ratchet mechanism 30 is free to rotate as illustrated in FIGS. 2 and 3 in the cylindrical apertures 112 and 116.

A cylindrical portion of the drive stud 18 extends upwardly from the drive wheel 26 through a cylindrical aperture 118 in the coverplate 20, and a cylindrical axle 120 extends downwardly from the drive wheel 26 and fits into a cylindrical aperture 60 disposed in the center of cavity 28. In this construction, the drive wheel 26 and drive stud 18 are free to rotate in the cylindrical apertures 118 and 60.

Referring now to FIG. 10, there is shown a detailed view of the drive wheel 26 and the drive gear 50, each disposed as if mounted in the wrench head 14. A plurality of teeth 130 are formed on the bottom side of the drive wheel 26 about the circumference thereof. Teeth 130 are dimensioned to mesh with the teeth 62 on the drive gear 50, and the teeth 130 and 62 interact at a 90 degree angle so that, as shown in FIG. 10, when torque is applied to gear 50, in addition to drive wheel 26 an upward force will be applied to wheel 26 and a downward force will be applied to the gear 50. A 90 degree interaction between the gear teeth 62 and 130 is preferred over beveled gearing because the gears are less likely to disengage or jump when a torque is applied to the drive gear 50. Such 90 degree interaction between the drive gear 50 and the wheel 26 will result in little or no force applied to the drive gear 50 in a rearward direction towards the handle 12 and the grip 16.

Although a particular embodiment has been described in the foregoing Detailed Description, it will be understood that the invention is capable of numerous rearrangements, modifications or substitutions of the parts without the departing from the spirit of the invention.

I claim:

1. In a ratchet wrench having an elongate handle, a head on one end of the handle, a drive wheel rotatably mounted in the head with a stud extending from the center thereof for insertion into wrench sockets, and a rod having a center axis and extending through the center of the handle into the head and adjacently to the drive wheel; the improvement comprising:

a beveled drive gear rotatably mounted on the rod for continuously engaging the drive wheel and for sliding axially along the rod;

retainer means for continuously securing and retaining said drive gear in a substantially stationary position relative to the drive wheel to prevent said drive gear from jumping out of engagement with the drive wheel;

beveled gear teeth formed on the drive wheel disposed circumferentially about the center of the wheel and being positioned to continuously engage and mesh with said drive gear;

interlock means for selectively locking said gear to the rod to selectively switch said drive gear from a free-wheeling mode to a drive mode for selectively rotatably driving the drive gear on an axis of rotation that is coaxial with the rod, said drive gear being operable in said drive mode to rotate in unison with said rod to drive said teeth on said drive wheel and rotate the drive wheel and the stud, said drive gear being operable in said free wheeling mode to rotate freely on said rod in response to rotation of the drive wheel, whereby the drive wheel and stud may be selectively rotated by switching the drive gear into the drive mode and rotating the rod about at center axis; and means for selectively rotating the rod.

2. The improvement of claim 1 wherein said interlock means comprises:

at least one projection extending from and being fixed on the rod;

at least one gear cavity formed in said gear and being dimensioned for receiving and mating with said projection;

mounting means for slidably mounting the rod in the handle so that the rod may be shifted in a direction parallel to its center axis to move said projection into said cavity to lock said drive gear on the rod and switch said drive gear into the drive mode.

3. The improvement of claim 2 further comprising at least one head cavity formed in said head and being dimensioned and positioned to snuggly receive said projection when the rod is shifted to remove said projection from said gear cavity, to switch said gear to the free-wheeling mode, said head cavity being operable to lock the rod in a fixed position relative to the wrench when said drive gear is in the free-wheeling mode.

4. The improvement of claim 3 wherein:

said at least one gear cavity is at least one gear slot formed in said gear;

said at least one projection is a pin fastened in and extending through the rod and being dimensioned to fit into said gear slot; and said at least one head cavity is at least one head slot formed in said head and being dimensioned to snuggly receive said pin.

5. The improvement of claim 3 further comprising:

a gap formed in said head between said drive gear and said head cavity, said gap being dimensioned to receive said projection and to allow said projection to rotate on the rod, so that when said projection is removed from said gear cavity it moves into said gap and may be rotated in said gap into alignment with said head cavity.

6. In a ratchet wrench having an elongate handle with first and second ends, a head disposed on the first end of the handle, a grip slidably mounted on the second end of the handle for axial sliding movement in a direction parallel to the handle and for sliding rotational movement about the handle, a rod fixedly attached to the grip and slidably mounted in a position extending through the handle and into the wrench head, a drive wheel rotatably mounted in the wrench head adjacent to the rod with a stud extending from the center thereof for insertion into wrench sockets, a toggle ratchet mechanism for engaging said drive wheel and being movable between first and second mechanism positions to prevent rotation of said drive wheel in a first rotational direction when the mechanism is in the first position and to prevent rotation of said drive wheel in a second rotational direction when the mechanism is in the second position, the improvement comprising:

a beveled drive gear rotatably mounted on the rod adjacent one end thereof for continuously engaging the drive wheel and for sliding axially along the rod;

retainer means for continuously engaging, securing and retaining said drive gear in a substantially stationary position on the rod relative to the drive wheel to prevent said drive gear from jumping out of engagement with the drive wheel;

a bore formed in the head of the ratchet wrench slidingly and snugly receiving the outermost end of the rod adjacent to said drive gear for supporting the rod and being dimensioned to allow sliding axial motion and rotation of the rod;

beveled gear teeth formed on the drive wheel disposed circumferentially about the center of the drive wheel and being positioned to continuously engage said drive gear; and a gear interlock means formed on said rod for selectively locking said drive gear to the rod to selectively switch said drive gear from a free wheeling mode to a drive mode in response to sliding axial movement of the rod and grip for selectively rotatably driving the drive gear on an axis of rotation that is coaxial with the rod, said drive gear being operable in the drive mode to rotate in unison with the rod to drive said teeth on said drive wheel to rotate the drive wheel and the stud, said drive gear being operable in the free-wheeling mode to rotate freely on said rod in response to rotation of said wheel, whereby the drive wheel and stud may be selectively rotated by sliding the grip axially to switch the drive gear into the drive mode and rotating the grip on the handle.

7. The improvement of claim 6 further comprising a wrench interlock means for locking the rod to said wrench in response to sliding axial movement of said grip to prevent rotation of said rod with respect to said wrench.

8. The improvement of claim 6 wherein said gear interlock comprises:

at least one projection extending from and being fixed on the rod; and at least one gear cavity formed in said gear and being dimensioned for receiving and mating with said projection, said projection being positioned on the rod so that sliding axial movement of the grip is operable to move said projection into said gear cavity.

9. The improvement of claim 6 further comprising a spring-biased catch means for catching and holding said rod in a first selected position when said drive gear is in the drive mode and in a second selected position when said drive gear is in the free-wheeling mode.

10. The improvement of claim 6 wherein said gear interlock means comprises:

at least one pin extending through the rod at a position on the rod proximate to said drive gear and projecting from at least one side of the rod; and at least one gear slot formed in said drive gear receiving and mating with said pin so that rotation of said rod causes rotation of said pin and drive gear.

11. The improvement of claim 10 further comprising:

at least one head slot formed in said head proximate to said pin for receiving and mating with said pin for locking the rod in a fixed rotational position relative to said wrench;

a gap formed in said head in a position between said drive gear and said head slot and being dimensioned to allow rotation of said pin in said gap so that when said pin is removed from said gear slot it may be rotated in said gap into alignment with said head slot for insertion therein.

12. The improvement of claim 6 further comprising:

an actuator mounted on said handle adjacent said grip; and transmission means connected between said actuator and said ratchet mechanism to transmit mechanism force therebetween for changing the ratchet action of the ratchet mechanism.

13. In a ratchet wrench having an elongate handle with first and second ends, a head on the first end of the handle, a grip slidably mounted on the second end of the handle for axial movement in a direction parallel to the handle and for sliding rotational movement on the handle, a rod fixedly mounted to the grip and slidably mounted in a position extending through the handle and into the wrench head, a drive wheel rotatably mounted in the head adjacent to the rod with a stud extending from the center thereof for insertion into wrench sockets, a toggle ratchet mechanism for engaging said drive wheel and being movable between first and second mechanism positions to prevent rotation of said drive wheel in a first rotational direction when the mechanism is in the first position and to prevent rotation of said drive wheel in a second rotational direction when the mechanism is in the second position, the improvement comprising:

a beveled drive gear rotatably mounted on the rod for continuously engaging the drive wheel and for sliding axially along the rod;

retainer means for continuously securing and retaining said drive gear in a substantially stationary position on the rod relative to the drive wheel to prevent said drive gear from jumping out of engagement with the drive wheel;

beveled gear teeth formed on the drive wheel disposed circumferentially about the center of the drive wheel and being positioned to continuously engage said drive gear;

gear interlock means formed on said rod for selectively locking said drive gear to the rod to selectively switch said drive gear from a free wheeling mode to a drive mode in response to sliding axial movement of the rod and grip for selectively rotatably driving the drive gear on an axis of rotation that is coaxial with the rod, said drive gear being operable in said drive mode to rotate in unison with said rod to drive the teeth on said drive wheel to rotate the wheel and the stud, said drive gear being operable in said free-wheeling mode to rotate freely on said rod in response to rotation of said wheel, whereby the drive wheel and stud may be selectively rotated by sliding the grip axially to switch the drive gear into the drive mode and rotating the grip on the handle;

an actuator mounted on said handle adjacent said grip and being movable between first and second actuator positions; and transmission means connected between said actuator and the ratchet mechanism to transmit mechanical force therebetween so that the actuator moves the mechanism to the first mechanism position when said actuator is moved to the first actuator position and moves the mechanism to the second mechanism position when said actuator is moved to the second actuator position.

* * * * *